US011282349B2

(12) United States Patent
Wilkosz et al.

(10) Patent No.: US 11,282,349 B2
(45) Date of Patent: Mar. 22, 2022

(54) DEVICE, SYSTEM AND METHOD FOR CROWD CONTROL

(71) Applicant: MOTOROLA SOLUTIONS, INC., Chicago, IL (US)

(72) Inventors: Pawel Wilkosz, Myslenica (PL); Sebastian Slup, Cracow (PL); Marcin Herod, Cracow (PL)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 16/770,029

(22) PCT Filed: Dec. 15, 2017

(86) PCT No.: PCT/PL2017/050061
§ 371 (c)(1),
(2) Date: Jun. 4, 2020

(87) PCT Pub. No.: WO2019/117736
PCT Pub. Date: Jun. 20, 2019

(65) Prior Publication Data

US 2021/0241588 A1 Aug. 5, 2021

(51) Int. Cl.
*G08B 7/06* (2006.01)
*G06Q 50/26* (2012.01)
*H04R 27/00* (2006.01)

(52) U.S. Cl.
CPC ..... *G08B 7/066* (2013.01); *G06Q 50/265* (2013.01); *G08B 7/062* (2013.01); *H04R 27/00* (2013.01)

(58) Field of Classification Search
None
See application file for complete search history.

(56) References Cited

U.S. PATENT DOCUMENTS 3,761,890 A * 9/1973 Fritts ..... G08B 5/22 340/473
4,155,042 A * 5/1979 Permut ..... G08B 27/00 340/293

(Continued)

FOREIGN PATENT DOCUMENTS

WO 2014174737 A1 10/2014
WO 2017021230 A1 2/2017
WO 2018084725 A1 5/2018

OTHER PUBLICATIONS

"International Search Report" dated Aug. 10, 2018, issued in corresponding PCT Application No. PCT/PL2017/050061, Filed Dec. 15, 2017, entitled: "Device, System and Method for Crowd Control".

*Primary Examiner* — Curtis J King
(74) *Attorney, Agent, or Firm* — Perry + Currier, Inc.

(57) ABSTRACT

A device, system and method for crowd control is provided. An aural command is detected at a location using a microphone at the location. A computing device determines, based on video data received from one or more multimedia devices, whether one or more persons at the location are not following the aural command. The computing device modifies the aural command to generate a second version of the aural command based on one or more of the video data and multimedia data associated with the location. The computing device causes the second version of the aural command to be provided, to the one or more persons who are not following the aural command at the location, using one or more notification devices.

20 Claims, 9 Drawing Sheets

(56) References Cited

U.S. PATENT DOCUMENTS 5,165,465 A * 11/1992 Kenet ..... G08B 13/19 165/11.1
5,309,146 A * 5/1994 Kenet ..... G08B 19/005 340/540
5,936,515 A * 8/1999 Right ..... G08B 7/06 340/384.5
6,144,310 A * 11/2000 Morris ..... G08B 21/12 340/505
6,952,164 B2 * 10/2005 Junqua ..... G07B 15/00 235/380
6,952,666 B1 10/2005 Weise
7,612,655 B2 * 11/2009 Kolz ..... G08B 1/08 340/407.1
7,701,355 B1 * 4/2010 Billman ..... G08B 25/10 340/628
7,714,734 B1 * 5/2010 Billman ..... G08B 17/10 340/628
7,719,433 B1 * 5/2010 Billman ..... A62B 3/00 340/628
8,190,438 B1 * 5/2012 Nelissen ..... H04S 7/30 704/274
9,681,280 B2 6/2017 Balthasar
10,402,846 B2 * 9/2019 Bigioi ..... G06Q 30/0201
10,692,304 B1 * 6/2020 Deyaf ..... G08G 1/20
2003/0234725 A1 * 12/2003 Lemelson ..... G08B 29/186 340/521
2005/0212677 A1 * 9/2005 Byrne ..... G08B 7/062 340/574
2006/0071802 A1 * 4/2006 Right ..... G08B 5/36 340/628
2006/0117303 A1 6/2006 Gizinski
2008/0242261 A1 * 10/2008 Shimanuki ..... G08B 21/0446 455/404.2
2009/0027225 A1 * 1/2009 Farley ..... G08B 7/06 340/6.11
2009/0256697 A1 * 10/2009 Tallinger ..... B60Q 1/2611 340/472
2009/0270833 A1 * 10/2009 DeBelser ..... G06Q 10/10 604/500
2009/0305660 A1 * 12/2009 Liu ..... H04H 20/59 455/404.1
2010/0105331 A1 * 4/2010 Buehler ..... H04B 5/02 455/41.3
2011/0053129 A1 * 3/2011 Basson ..... G09B 19/00 434/238
2011/0117874 A1 * 5/2011 Shaw ..... G08B 27/006 455/404.1
2011/0220469 A1 * 9/2011 Freiburger ..... B60K 37/06 200/61.54
2011/0291827 A1 * 12/2011 Baldocchi ..... G08B 25/08 340/539.11
2012/0190344 A1 * 7/2012 Yeh ..... H04M 11/10 455/413
2012/0320955 A1 * 12/2012 Ueda ..... H04W 52/0274 375/219
2013/0247093 A1 * 9/2013 Wang ..... G08B 27/005 725/33
2013/0268260 A1 10/2013 Lundberg
2013/0282430 A1 10/2013 Kannan
2014/0003586 A1 * 1/2014 Agrawal ..... H04R 27/00 379/37
2014/0129946 A1 * 5/2014 Harris ..... G06F 3/01 715/733
2014/0320282 A1 * 10/2014 Zhang ..... G08B 27/001 340/502
2015/0054644 A1 * 2/2015 Kowalski ..... G08B 25/006 340/517
2015/0065078 A1 * 3/2015 Mejia ..... H04M 11/04 455/404.1
2016/0009175 A1 * 1/2016 McNew ..... G01C 21/3652 340/438
2016/0035202 A1 * 2/2016 Chin ..... G08C 17/02 340/539.11
2016/0050037 A1 * 2/2016 Webb ..... G08B 27/005 455/3.01
2016/0071393 A1 * 3/2016 Kaplan ..... B60K 28/066 340/539.12
2016/0125726 A1 * 5/2016 Gordon ..... G08B 7/06 340/504
2016/0140831 A1 * 5/2016 Hermann ..... G08B 21/245 340/573.1
2016/0269882 A1 9/2016 Balthasar
2017/0091998 A1 * 3/2017 Piccolo, III ..... G06F 3/147
2017/0103491 A1 * 4/2017 Bora ..... G06Q 90/205
2017/0206095 A1 * 7/2017 Gibbs ..... G06T 13/40
2017/0309142 A1 10/2017 Phillips
2018/0047279 A1 * 2/2018 Probin ..... H04L 67/12
2019/0019218 A1 * 1/2019 Thompson ..... G09F 19/14
2019/0082044 A1 * 3/2019 Melendez ..... H04M 1/72421
2019/0141463 A1 * 5/2019 Cabouli ..... B64C 39/024
2020/0058303 A1 * 2/2020 Bostick ..... H04L 12/1845
2020/0092676 A1 * 3/2020 Kuenzi ..... G06F 21/34
2021/0004928 A1 * 1/2021 Azim ..... H04N 7/188
2021/0015404 A1 * 1/2021 Arar ..... H04R 25/554
2021/0114514 A1 * 4/2021 Karol ..... G06N 5/04

* cited by examiner

DEVICE, SYSTEM AND METHOD FOR CROWD CONTROL

BACKGROUND OF THE INVENTION

In crisis situations (e.g. a terrorist attack, and the like), first responders, such as police officers, generally perform crowd control, for example by issuing verbal commands (e.g. "Please move to the right", "Please move back", "Please move this way" etc.). However, in such situations, some people in the crowd may not understand the commands and/or may be confused; either way, the commands may not be followed by some people, which may make a public safety incident worse and/or may place people not following the commands in danger. While the police officer may resort to using a megaphone and/or other devices, to reissue commands, for example to increase the loudness of the commands using technology, electrical and/or processing resources at such devices is wasted when the people again fail to follow the commands due to continuing confusion.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
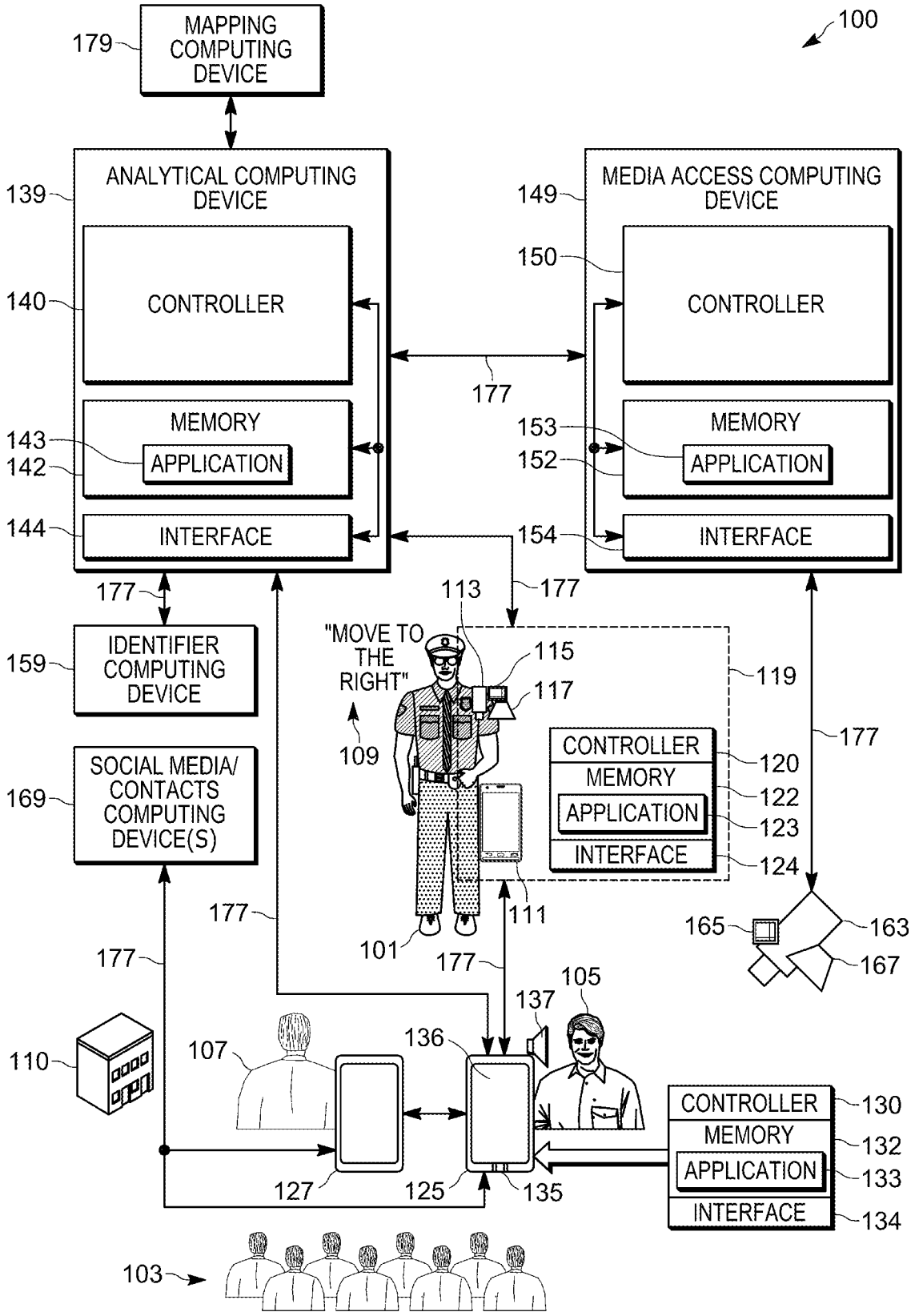
FIG. 1 is a system for crowd control and further depicts an aural command being detected at a location in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

An aspect of the specification provides a method comprising: detecting, at one or more computing devices, that an aural command has been detected at a location using a microphone at the location; determining, at the one or more computing devices, based on video data received from one or more multimedia devices whether one or more persons at the location are not following the aural command; modifying the aural command, at the one or more computing devices, to generate a second version of the aural command based on one or more of the video data and multimedia data associated with the location; and causing, at the one or more computing devices, the second version of the aural command to be provided, to the one or more persons who are not following the aural command at the location using one or more notification devices.

Another aspect of the specification provides a computing device comprising: a controller and a communication interface, the controller configured to: detect that an aural command has been detected at a location using a microphone at the location, the communication interface configured to communicate with the microphone; determine, based on video data received from one or more multimedia devices, whether one or more persons at the location are not following the aural command, the communication interface further configured to communicate with the one or more multimedia devices; modify the aural command to generate a second version of the aural command based on one or more of the video data and multimedia data associated with the location; and cause the second version of the aural command to be provided, to the one or more persons who are not following the aural command at the location using one or more notification devices, the communication interface further configured to communicate with the one or more multimedia devices.

Attention is directed to FIG. 1, which depicts a system 100 for crowd control, for example crowd control at an incident scene at which an incident is occurring. For example, as depicted, a responder 101, such as a police officer, is attempting to control a crowd 103 that includes persons 105, 107. The responder 101 is generally attempting to control the crowd 103, for example by issuing an aural command 109, for example to tell the crowd to "MOVE TO THE RIGHT", with the intention of having the crowd move towards a building 110 to the "right" of the responder 101. As depicted, the person 105 is facing in a different direction from the remainder of the crowd 103, including the person 107, and hence the person 105 may be confused as to a direction to move: for example, as the term "right" is relative, the person 105 may not understand whether "right" is to the right of the responder 101, the remainder of the crowd 103, or another "right", for example a "right" of people facing the responder 101. Indeed, the responder 101 may gesture in the direction he intends the crowd 103 to move (e.g. towards the building 110), but the person 105 may not see the gesture. Hence, at least the person 105 may not move towards the building 110, and/or may move in a direction that is not intended by the aural command 109, which may place the person 105 in danger.

As depicted, the responder 101 is carrying a communication and/or computing device 111 and is further wearing a body-worn camera 113, which may include a microphone 115 and/or a speaker 117. Alternatively, the microphone 115 and/or the speaker 117 may be separate from the body-worn camera 113. Alternatively, the microphone 115 and/or the speaker 117 may be components of the computing device 111. Alternatively, the computing device 111 may include a camera and/or the camera 113 may be integrated with the computing device 111. Regardless, the computing device 111, the camera 113, the microphone 115 and the speaker 117 form a personal area network (PAN) 119 of the responder 101. While not depicted, the PAN 119 may include other sensors, such as a gas sensor, an explosive detector, a biometric sensor, and the like, and/or a combination thereof.

The camera 113 and/or the microphone 115 generally generate one or more of video data, audio data and multimedia data associated with the location of the incident scene; for example, the camera 113 may be positioned to generate video data of the crowd 103, which may include the person 105 and the building 110, and the microphone 115 may be positioned to generate audio data of the crowd 103, such as voices of the persons 105, 107. Alternatively, the computing device 111 may include a respective camera and/or respective microphone which generate one or more of video data, audio data and multimedia data associated with the location of the incident scene.

The PAN 119 further comprises a controller 120, a memory 122 storing an application 123 and a communication interface 124 (interchangeably referred to hereafter as the interface 124). The computing device 111 and/or the PAN 119 alternatively further includes a display device and/or one or more input devices. The controller 120, the memory 122, and the interface 124 may be located at the computing device 111, the camera 113, the microphone 115 and the speaker 117 and/or a combination thereof. Regardless, the controller 120 is generally configured to communicate with components of the PAN 119 via the interface 124, as well as other components of the system 100, as described below.

The system 100 further comprises a communication and/or computing device 125 of the person 105, and a communication and/or computing device 127 of the person 107. As schematically depicted in FIG. 1, the computing device 125 includes a controller 130, a memory 132 storing an application 133 and a communication interface 134 (interchangeably referred to hereafter as the interface 134). While the controller 130, the memory 132, and the interface 134 are schematically depicted as being beside the computing device 111, it is appreciated that the arrow between the computing device 125 and the controller 130, the memory 132, and the interface 134 indicates that such components are located at (e.g. inside) the computing device 125. As depicted, the computing device 125 further includes a microphone 135, a display device 136, and a speaker 137, as well as one or more input devices. While not depicted, the computing device 125 may further include a camera, and the like. While not depicted, the computing device 125 may be a component of a PAN of the person 105.

The controller 130 is generally configured to communicate with components of the computing device 125, as well as other components of the system 100 via the interface 134, as described below.

While details of the computing device 127 are not depicted, the computing device 127 may have the same structure and/or configuration as the computing device 125.

Each of the computing devices 111, 125, 127 may comprise a mobile communication device (as depicted), including, but not limited to, any suitable combination of radio devices, electronic devices, communication devices, computing devices, portable electronic devices, mobile computing devices, portable computing devices, tablet computing devices, telephones, PDAs (personal digital assistants), cellphones, smartphones, e-readers, mobile camera devices and the like.

In some embodiments, the computing device 111 is specifically adapted for emergency service radio functionality, and the like, used by emergency responders and/or emergency responders, including, but not limited to, police service responders, fire service responders, emergency medical service responders, and the like. In some of these embodiments, the computing device 111 further includes other types of hardware for emergency service radio functionality, including, but not limited to, push-to-talk ("PTT") functionality. Indeed, the computing device 111 may be configured to wirelessly communicate over communication channels which may include, but are not limited to, one or more of wireless channels, cell-phone channels, cellular network channels, packet-based channels, analog network channels, Voice-Over-Internet ("VoIP"), push-to-talk channels and the like, and/or a combination. Indeed, the term "channel" and/or "communication channel", as used herein, includes, but is not limited to, a physical radio-frequency (RF) communication channel, a logical radio-frequency communication channel, a trunking talkgroup (interchangeably referred to herein a "talkgroup"), a trunking announcement group, a VOIP communication path, a push-to-talk channel, and the like.

The computing devices 111, 125, 127 may further include additional or alternative components related to, for example, telephony, messaging, entertainment, and/or any other components that may be used with computing devices and/or communication devices.

Each of the computing devices 125, 127 may comprise a mobile communication device (as depicted) similar to the computing devices 111, however adapted for use as a consumer device and/or business device, and the like.

Furthermore, in some embodiments, each of the computing devices 111, 125, 127 may comprise: a respective location determining device, such a global positioning system (GPS) device, and the like; and/or a respective orientation determining device for determining an orientation, such as a magnetometer, a gyroscope, an accelerometer, and the like. Hence, each of the computing devices 111, 125, 127 may be configured to determine their respective location and/or respective orientation (e.g. a cardinal and/or compass direction) and furthermore transmit and/or report their respective location and/or their respective orientation to other components of the system 100.

As depicted, the system 100 further includes an analytical computing device 139 that comprises a controller 140, a memory 142 storing an application 143, and a communication interface 144 (interchangeably referred to hereafter as the interface 144). The controller 140 is generally configured to communicate with components of the computing device 139, as well as other components of the system 100 via the interface 144, as described below.

Furthermore, in some embodiments, the analytical computing device 139 may be configured to perform one or more machine learning algorithms, pattern recognition algorithms, data science algorithms, and the like, on video data and/or audio data and/or multimedia data received at the analytical computing device 139, for example to determine whether one or more persons at a location are not following an aural command and to generate a second version of the aural command based on one or more of the video data and multimedia data associated with the location. However, such functionality may also be implemented at other components of the system 100.

As depicted, the system 100 further includes a media access computing device 149 that comprises a controller 150, a memory 152 storing an application 153, and a communication interface 154 (interchangeably referred to hereafter as the interface 154). The controller 150 is generally configured to communicate with components of the computing device 149, as well as other components of the system 100 via the interface 154, as described below. In particular, the computing device 149 is configured to communicate with at least one camera 163 (e.g. a closed-circuit television (CCTV) camera, a video camera, and the like) at the location of the incident scene, as well as at least one optional microphone 165, and at least one optional speaker 167. The optional microphone 165 and speaker 167 may be components of the at least one camera 163 (e.g. as depicted) and/or may be separate from the at least one camera 163. Furthermore, the at least one camera 163 (and/or the microphone 165 and speaker 167) may be a component of a public safety monitoring system and/or may be a component of a commercial monitoring and/or private security system to which the computing device 149 has been provided access. The camera 163 and/or the microphone 165 generally generate one or more of video data, audio data and multimedia data associated with the location of the incident scene; for example, the camera 163 may be positioned to generate video data of the crowd 103, which may include the building 110, and the microphone 165 may be positioned to generate audio data of the crowd 103, such as voices of the persons 105, 107.

Furthermore, in some embodiments, the media access computing device 149 may be configured to perform video and/or audio analytics on video data and/or audio data and/or multimedia received from the at least one camera 163 (and/or the microphone 165)

As depicted, the system 100 may further comprise an optional identifier computing device 159 which is generally configured to determine identifiers (e.g. one or more of telephone numbers, network addresses, email addresses, internet protocol (IP) addresses, media access control (MAC) addresses, and the like) associated with communication devices at a given location. While components of the identifier computing device 159 are not depicted, it is assumed that the identifier computing device 159 also comprises a respective controller, memory and communication interface. The identifier computing device 159 may determine associated device identifiers of communication devices at a given location, such as the communication and/or computing devices 125, 127, for example by communicating with communication infrastructure devices with which the computing devices 125, 127 are in communication. While the communication infrastructure devices are not depicted, they may include, but are not limited to, cell phone and/or WiFi communication infrastructure devices and the like. Alternatively, one or more of the computing devices 125, 127 may be registered with the identifier computing device 159 (such registration including providing of an email address, and the like), and periodically report their location (and/or their orientation) to the identifier computing device 159.

As depicted, the system 100 may further comprise at least one optional social media and/or contacts computing device 169 which stores social media data and/or contact data associated with the computing devices 125, 127. The social media and/or contacts computing device 169 may also store locations of the computing devices 125, 127 and/or presentity data and/or presence data of the computing devices 125, 127, assuming the computing devices 125, 127 periodically report their location and/or presentity data and/or presence to the social media and/or contacts computing device 169.

While components of the social media and/or contacts computing device 169 are not depicted, it is assumed that the social media and/or contacts computing device 169 also comprises a respective controller, memory and communication interface.

As depicted, the system 100 may further comprise at least one optional mapping computing device 179 which stores and/or generates mapping multimedia data associated with a location; such mapping multimedia data may include maps and/or images and/or satellite images and/or models (e.g. of buildings, landscape features, etc.) of a location. While components of the mapping computing device 179 are not depicted, it is assumed that the mapping computing device 179 also comprises a respective controller, memory and communication interface.

The components of the system 100 are generally configured to communicate with each other via communication links 177, which may include wired and/or wireless links (e.g. cables, communication networks, the Internet, and the like) as desired.

Furthermore, the computing devices 139, 149, 159, 169, 179 of the system 100 may be co-located and/or remote from each other as desired. Indeed, in some embodiments, subsets of the computing devices 139, 149, 159, 169, 179 may be combined to share processing and/or memory resources; in these embodiments, links 177 between combined components are eliminated and/or not present. Indeed, the computing devices 139, 149, 159, 169, 179 may include one or more servers, and the like, configured for their respective functionality.

As depicted, the PAN 119 is configured to communicate with the computing device 139 and the computing device 125. The computing device 125 is configured to communicate with the computing devices 111, 127, and each of the computing devices 125, 127 are configured to communicate with the social media and/or contacts computing device 169. The analytical computing device 139 is configured to communicate with the computing device 111, the media access computing device 149 and the identifier computing device 159. The media access computing device 149 is configured to communicate with the analytical computing device 139 and the camera 163, the microphone 165 and the speaker 167. However, the components of the system 100 may be configured to communicate with each other in plurality of different configurations, as described in more detail below.

Indeed, the system 100 is generally configured to: detect, at one or more of the computing devices 111, 125, 139, 149, that an aural command (e.g. such as the aural command 109) has been detected at a location using a microphone 115, 135, 165 at the location; determine, at the one or more computing devices 111, 125, 139, 149, based on video data received from one or more multimedia devices (e.g. the cameras 113, 163) whether one or more persons 105, 107 at the location are not following the aural command; modify the aural command, at the one or more computing devices 111, 125, 139, 149, to generate a second version of the aural command based on one or more of the video data and multimedia data associated with the location; and cause, at the one or more computing devices 111, 125, 139, 149, the second version of the aural command to be provided, to the one or more persons 105, 107 who are not following the aural command at the location using one or more notification devices (e.g. the speakers 117, 137, 167, the display device 136, and the like).

In other words, the functionality of the system 100 may be distributed between one or more of the computing devices 111, 125, 139, 149.

Each of the controllers 120, 130, 140, 150 includes one or more logic circuits configured to implement functionality for crowd control. Example logic circuits include one or more processors, one or more electronic processors, one or more microprocessors, one or more ASIC (application-specific integrated circuits) and one or more FPGA (field-programmable gate arrays). In some embodiments, one or more of the controllers 120, 130, 140, 150 and/or one or more of the computing devices 111, 125, 139, 149 are not generic controllers and/or a generic computing devices, but controllers and/or computing device specifically configured to implement functionality for crowd control. For example, in some embodiments, one or more of the controllers 120, 130, 140, 150 and/or one or more of the computing devices 111, 125, 139, 149 specifically comprises a computer executable engine configured to implement specific functionality for crowd control.

The memories 122, 132, 142, 152 each comprise a machine readable medium that stores machine readable instructions to implement one or more programs or applications. Example machine readable media include a non-volatile storage unit (e.g. Erasable Electronic Programmable Read Only Memory ("EEPROM"), Flash Memory) and/or a volatile storage unit (e.g. random-access memory ("RAM")). In the embodiment of FIG. 1, programming instructions (e.g., machine readable instructions) that implement the functional teachings of the computing devices 111, 125, 139, 149 as described herein are maintained, persistently, at the memories 122, 132, 142, 152 and used by the respective controllers 120, 130, 140, 150 which makes appropriate utilization of volatile storage during the execution of such programming instructions.

For example, each of the memories 122, 132, 142, 152 store respective instructions corresponding to the applications 123, 133, 143, 153 that, when executed by the respective controllers 120, 130, 140, 150 implement the respective functionality of the system 100. For example, when one or more of the controllers 120, 130, 140, 150 implement a respective application 123, 133, 143, 153, one or more of the controller 120, 130, 140, 150 are configured to: detect that an aural command (e.g. such as the aural command 109) has been detected at a location using a microphone 115, 135, 165 at the location; determine, based on video data received from one or more multimedia devices (e.g. the cameras 113, 163) whether one or more persons 105, 107 at the location are not following the aural command; modify the aural command to generate a second version of the aural command based on one or more of the video data and multimedia data associated with the location; and cause the second version of the aural command to be provided, to the one or more persons 105, 107 who are not following the aural command at the location using one or more notification devices (e.g. the speakers 117, 137, 167, the display device 136, and the like).

The interfaces 124, 134, 144, 154 are generally configured to communicate using respective links 177 which are wired and/or wireless as desired. The interface 124, 134, 144, 154 may implemented by, for example, one or more cables, one or more radios and/or connectors and/or network adaptors, configured to communicate wired and/or wirelessly, with network architecture that is used to implement the respective communication links 177.

The interfaces 124, 134, 144, 154 may include, but are not limited to, one or more broadband and/or narrowband transceivers, such as a Long Term Evolution (LTE) transceiver, a Third Generation (3G) (3GGP or 3GGP2) transceiver, an Association of Public Safety Communication Officials (APCO) Project 25 (P25) transceiver, a Digital Mobile Radio (DMR) transceiver, a Terrestrial Trunked Radio (TETRA) transceiver, a WiMAX transceiver operating in accordance with an IEEE 802.16 standard, and/or other similar type of wireless transceiver configurable to communicate via a wireless network for infrastructure communications. Furthermore, the broadband and/or narrowband transceivers of the interfaces 124, 134, 144, 154 may be dependent on functionality of a device of which they are a component. For example, the interfaces 124, 144, 154 of the computing devices 111, 139, 149 may be configured as public safety communication interfaces and hence may include broadband and/or narrowband transceivers associated with public safety functionality, such as an Association of Public Safety Communication Officials (APCO) Project 25 transceiver, a Digital Mobile Radio transceiver, a Terrestrial Trunked Radio transceiver and the like. However, the interface 134 of the computing device 125 may exclude such broadband and/or narrowband transceivers associated with emergency service and/or public safety functionality; rather, the interface 134 of the computing device 125 may include broadband and/or narrowband transceivers associated with commercial and/or business devices, such as a Long Term Evolution transceiver, a Third Generation transceiver, a WiMAX transceiver, and the like.

In yet further embodiments, the interfaces 124, 134, 144, 154 may include one or more local area network or personal area network transceivers operating in accordance with an IEEE 802.11 standard (e.g., 802.11a, 802.11b, 802.11g), or a Bluetooth™ transceiver which may be used to communicate to implement the respective communication links 177.

However, in other embodiments, the interfaces 124, 134, 144, 154 communicate over the links 177 using other servers and/or communication devices and/or network infrastructure devices, for example by communicating with the other servers and/or communication devices and/or network infrastructure devices using, for example, packet-based and/or internet protocol communications, and the like. In other words, the links 177 may include other servers and/or communication devices and/or network infrastructure devices, other than the depicted components of the system 100.

In any event, it should be understood that a wide variety of configurations for the computing devices 111, 125, 139, 149 are within the scope of present embodiments.

Figure 2:
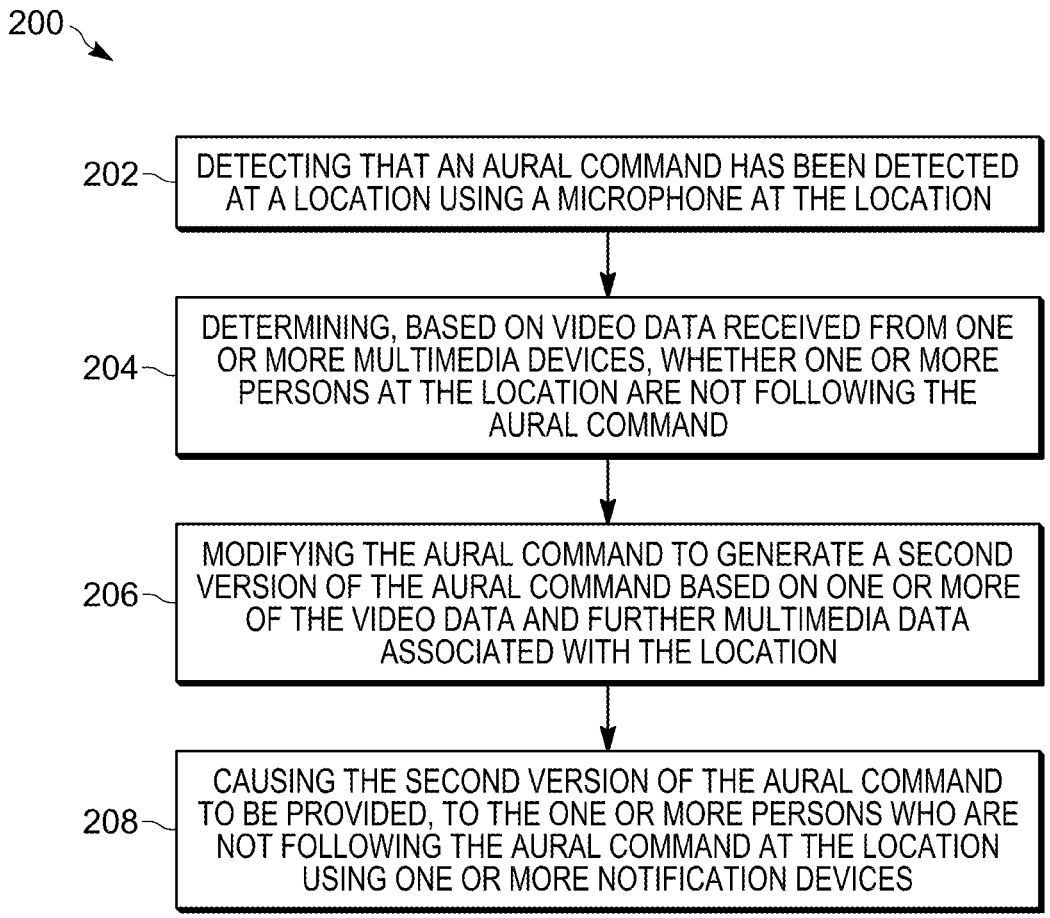
FIG. 2 is a flowchart of a method for crowd control in accordance with some embodiments.

Attention is now directed to FIG. 2 which depicts a flowchart representative of a method 200 for crowd control. The operations of the method 200 of FIG. 2 correspond to machine readable instructions that are executed by, for example, one or more of the computing devices 111, 125, 139, 149, and specifically by one or more of the controllers 120, 130, 140, 150 of the computing devices 111, 125, 139, 149. In the illustrated example, the instructions represented by the blocks of FIG. 2 are stored at one or more of the memories 122, 132, 142, 152, for example, as the applications 123, 133, 143, 153. The method 200 of FIG. 2 is one way in which the controllers 120, 130, 140, 150 and/or the computing devices 111, 125, 139, 149 and/or the system 100 is configured. Furthermore, the following discussion of the method 200 of FIG. 2 will lead to a further understanding of the system 100, and its various components. However, it is to be understood that the method 200 and/or the system 100 may be varied, and need not work exactly as discussed herein in conjunction with each other, and that such variations are within the scope of present embodiments.

The method 200 of FIG. 2 need not be performed in the exact sequence as shown and likewise various blocks may be performed in parallel rather than in sequence. Accordingly, the elements of method 200 are referred to herein as "blocks" rather than "steps." The method 200 of FIG. 2 may be implemented on variations of the system 100 of FIG. 1, as well.

At a block 202, one or more of the controllers 120, 130, 140, 150 detect that an aural command (e.g. such as the aural command 109) has been detected at a location using a microphone 115, 135, 165 at the location At a block 204, one or more of the controllers 120, 130, 140, 150 determine, based on video data received from one or more multimedia devices (e.g. the cameras 113, 163) whether one or more persons 105, 107 at the location are not following the aural command;

At a block 206, one or more of the controllers 120, 130, 140, 150 modify the aural command to generate a second version of the aural command based on one or more of the video data and multimedia data associated with the location; and At a block 208, one or more of the controllers 120, 130, 140, 150 cause the second version of the aural command to be provided, to the one or more persons 105, 107 who are not following the aural command at the location using one or more notification devices (e.g. the speakers 117, 137, 167, the display device 136, and the like).

Example embodiments of the method 200 will now be described with reference to FIG. 3 to FIG. 9.

Figure 3:
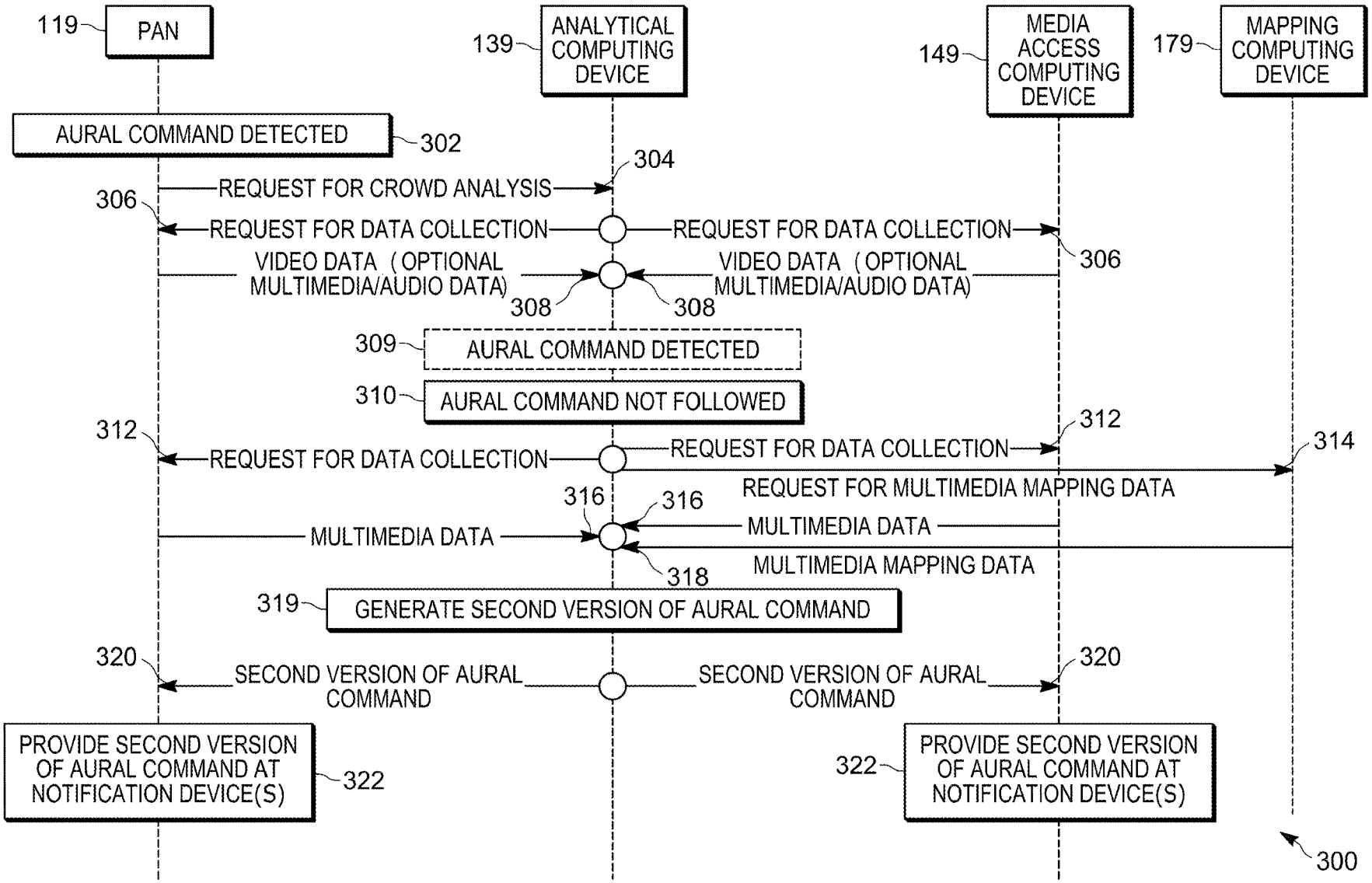
FIG. 3 is a signal diagram showing communication between the components of the system of FIG. 1 when implementing the method for crowd control in accordance with some embodiments.

Attention is next directed to FIG. 3 which depicts a signal diagram 300 showing communication between the PAN 119, the analytical computing device 139, the media access computing device 149 and (optionally) the mapping computing device 179 in an example embodiment of the method 200. It is assumed in FIG. 3 that the controller 120 is executing the application 123, the controller 140 is executing the application 143, and the controller 150 is executing the application 153. In these embodiments, the computing device 125 is passive, at least with respect to implementing the method 200.

As depicted, the PAN 119 detects 302 (e.g. at the block 202 of the method 200) the aural command 109, for example by way of the controller 120 receiving aural data from the microphone 115 and comparing the aural data with data representative of commands. For example, the application 123 may be preconfigured with such data representative of commands, and the controller 120 may compare words of the aural command 109, as received in the aural data with the data representative of commands. Hence, the words "MOVE TO THE RIGHT" of the aural command 109, as they contain the word "MOVE" and the word "RIGHT", and the like, may trigger the controller 120 of the PAN 119 to detect 302 the aural command 109, and responsively transmit a request 304 to the analytical computing device 139 for analysis of the crowd 103. The request 304 may include a recording (and/or streaming) of the aural command 109 such that the analytical computing device 139 receives the aural data representing the aural command 109.

The analytical computing device 139 transmits requests 306 for data collection to one or more of the PAN 119 and the media access computing device 149, which responsively transmit 308 video data (which may include audio data) to the analytical computing device 139. Such video data is acquired at one or more of the cameras 113, 163.

In alternative embodiments, as depicted, the analytical computing device 139 detects 309 the aural command 109, for example in the aural data received in multimedia transmissions (e.g. at the transmit 308) from one or more of the PAN 119 and the media access computing device 149. In these embodiments, the PAN 119 may not detect 302 the aural command 109; rather, the analytical computing device 139 may periodically transmit requests 306 for multimedia data (e.g. that includes video data and aural data) to one or more of the PAN 119 and the media access computing device 149 and detect 309 the aural command 109 in the received multimedia data (e.g. as aural data representing the aural command 109), similar to the PAN 119 detecting the aural command 109.

In either embodiment, the analytical computing device 139 detects 310 (e.g. at the block 204 of the method 200) that the aural command 109 is not followed by one or more persons (e.g. the person 105). For example, the video data that is received from one or more of the PAN 119 and the media access computing device 149 may show that the crowd 103 is generally moving "right" towards the building 110, but the person 105 is not moving towards the building 110, but is either standing still or moving in a different direction. Furthermore, the analytical computing device 139 may process the aural data representing the aural command 109 to extract the meaning of the aural command 109, relative to the received video data; for example, with regards to relative terms, such as "RIGHT", the analytical computing device 139 may be configured to determine that such relative terms are relative to the responder 101 (e.g. the right of the responder 101); alternatively, when the video data includes the responder 101 gesturing in a given direction, the analytical computing device 139 may be configured to determine that the gesture is in the relative direction indicated in the aural command 109.

Hence, in an example embodiment, the analytical computing device 139 detects 310 (e.g. in the video data received one or more of the PAN 119 and the media access computing device 149) that the person 105 is not moving to either the right of the responder 101 and/or not moving in a direction indicated by a gesture of the responder 101. Such a determination may occur using one or more of visual analytics (e.g. on the video data), machine learning algorithms, pattern recognition algorithms, and/or data science algorithms at the application 143. Furthermore, the media access computing device 149 may further provide data indicative of analysis of the video data and/or multimedia data received from the camera 163, for example to provide further processing resources to the analytical computing device 139.

As depicted, when the analytical computing device 139 detects 310 (e.g. at the block 204 of the method 200) that the aural command 109 is not followed, the analytical computing device 139 may alternatively transmit requests 312 for multimedia data collection to one or more of the PAN 119 and the media access computing device 149; similarly, the analytical computing device 139 may alternatively transmit a request 314 for mapping multimedia data to the mapping computing device 179 (e.g. the request 314 including the location of the device 111 and/or the incident scene, as received, for example, from the PAN 119, for example in the request 304 for crowd analysis and/or when the PAN 119 transmits 308 the video data; it is assumed, for example, that the location of the device 111 is also the location of the incident scene).

The one or more of the PAN 119 and the media access computing device 149 responsively transmit 316 multimedia data (which may include video data and/or audio data) to the analytical computing device 139. Such multimedia data is acquired at one or more of the cameras 113, 163, and may include aural data from the microphones 115, 165. Similarly, the mapping computing device 179 alternatively transmits 318 multimedia mapping data of the location of the incident scene. However, receipt such multimedia data is optional.

The analytical computing device 139 generates 319 (e.g. at the block 206 of the method 200) a second version of the aural command 109 based on one or more of the video data (e.g. received when one or more of the PAN 119 and the media access computing device 149 transmits 308 the video data) and the multimedia data associated with the location (e.g. received when one or more of the PAN 119, the media access computing device 149, and the mapping computing device 179 transmits 316, 318 multimedia data).

In particular, the analytical computing device 139 generates 319 the second version of the aural command 109 by modifying the aural command 109. The second version of the aural command 109 may include a modified and/or simplified version of the aural command and/or a version of the aural command 109 where relative terms are replaced with geographic terms and/or geographic landmarks and/or absolute terms and/or absolute directions (e.g. a cardinal and/or compass direction). Furthermore, the second version of the aural command 109 may include visual data (e.g. an image that includes text and/or pictures indicative of second version of the aural command 109) and/or aural data (e.g. audio data that is playable at a speaker).

For example, the multimedia data received when one or more of the PAN 119, the media access computing device 149, and the mapping computing device 179 transmits 316, 318 multimedia data may indicate that the building 110 is in the relative direction of the aural command 109. Hence, the second version of the aural command 109 may include text and/or images and/or aural data that indicate "MOVE TO THE RED BUILDING", e.g. assuming that the building 110 is red. Similarly, the second version of the aural command 109 may include text and/or images and/or aural data that indicate "MOVE TO THE BANK", e.g. assuming that the building 110 is a bank. Put another way, the second version of the aural command 109 may include an instruction that references a geographic landmark at the location of the incident scene.

Similarly, the second version of the aural command 109 may include text and/or images and/or aural data that indicate "MOVE TO THE WEST", e.g. assuming that the right of the responder 101 is west (which may be determined from a direction of the gesture of the responder 101 and/or an orientation of the device 111, assuming the orientation of the device 111 is received from the PAN 119 in the request 304 for crowd analysis and/or when the PAN 119 transmits 308 the video data and/or transmits 316 the multimedia data).

In yet further embodiments, multimedia data (e.g. aural data) from one or more of the microphones 115, 165 may enable the analytical computing device 139 to determine that a given melody and/or given sound is occurring at the building 110 (e.g. a speaker at the building 110 may be playing a Christmas carol, and the like). Hence, the second version of the aural command 109 may include text and/or images and/or aural data that indicate "MOVE TO TOWARDS THE CHRISTMAS CAROL". Indeed, these embodiments may be particularly useful for blind people when the second version of the aural command 109 is played at one or more of the speakers 117, 137, 167, as described in more detail below.

Hence, the aural command 109 is modified and/or simplified to replace a relative direction with a geographic term and/or a geographic landmark and/or an absolute term and/or an absolute direction (e.g. a cardinal and/or compass direction).

Such a determination of a geographic term and/or a geographic landmark and/or an absolute term and/or an absolute direction that may replace a relative term in the aural command 109 (and/or how to simplify and/or modify the aural command 109) may occur using one or more machine learning algorithms, pattern recognition algorithms, and/or data science algorithms at the application 143. For example, a cardinal direction "WEST" and/or may be determined from an orientation of the device 111, and/or by comparing video data from one or more of the cameras 113, 163 with the multimedia mapping data. Similarly, the color and/or location and/or function of the building 110 may be determined using the video data and/or the multimedia mapping data.

The analytical computing device 139 transmits 320 (e.g. at the block 208 of the method 200) the second version of the aural command 109 to one or more of the PAN 119 and the media access computing device 149 to cause the second version of the aural command 109 to be provided, to the one or more persons (e.g. the person 105) who are not following the aural command 109 at the location using one or more notification devices.

For example, as depicted one or more of the PAN 119 and the media access computing device 149 provides 322 the second version of the aural command 109 at one or more notification devices, such as one or more of the speakers 117, 167.

Figure 4:
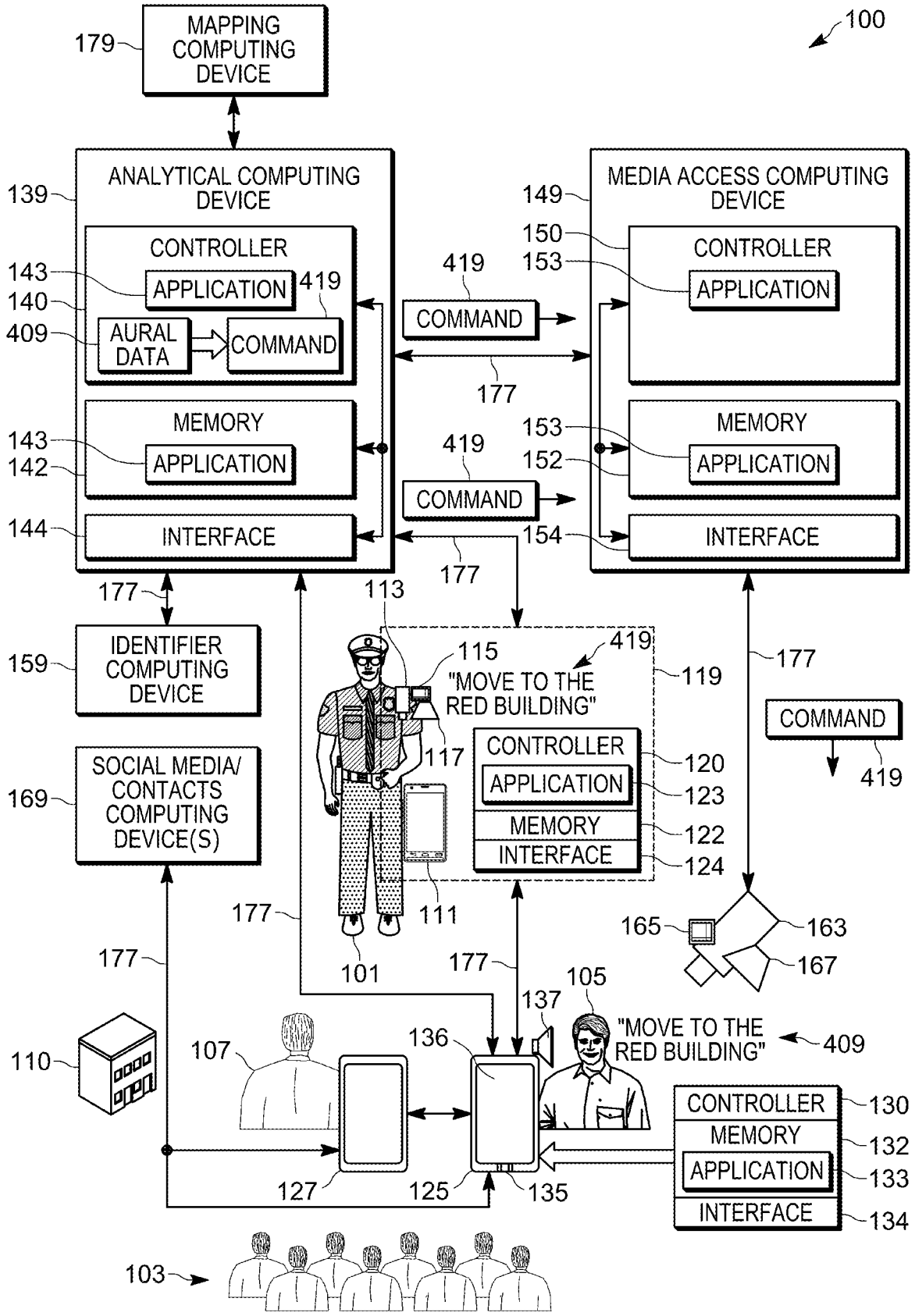
FIG. 4 depicts a second version of the aural command being provided to one or more persons who are not following the aural command in accordance with some embodiments.

For example, attention is directed to FIG. 4, which is substantially similar to FIG. 1, with like elements having like numbers. In FIG. 4, the controller 120 is implementing the application 123, the controller 130 is implementing the application 133, and the controller 140 is implementing the application 143. It is assumed in FIG. 4 that that the method 200 has been implemented as described above with respect to the signal diagram 300, and that the analytical computing device 139 has modified the aural command 109 (or rather aural data 409 representing the aural command 109) to generate a second version 419 of the aural command 109 (e.g. as depicted "MOVE TO THE RED BUILDING"). The second version 419 of the aural command 109 is transmitted to one or more of the PAN 119 and the media access computing device 149. As depicted, the second version 419 of the aural command 109 is played as aural data emitted from the speaker 117 by the PAN 119; the second version 419 of the aural command 109 may hence be heard by the person 105 who may then follow the second version 419, which includes absolute terms rather than relative terms. Put another way, causing the second version of the aural command 109 to be provided to the one or more persons who are not following the aural command 109 at a location using the one or more notification devices may comprise: providing the second version of the aural command 109 to a communication device (e.g. the computing device 111) of a person that provided the aural command 109.

As depicted, the media access computing device 149 transmits the second version 419 of the aural command 109 to the speaker 167, where the second version 419 of the aural command 109 is played by the speaker 167, and which may also be heard by the person 105.

Hence, the second version of the aural command 109, as described herein, may comprise one or more of: a second aural command provided at a speaker notification device (such as the speakers 117, 137, 167); and a visual command provided at a visual notification device (e.g. such as the display device 136).

However, in other embodiments, the second version 419 of the aural command 109 may be transmitted to the computing device 125 to be provided at one or more notification devices.

Figure 5:
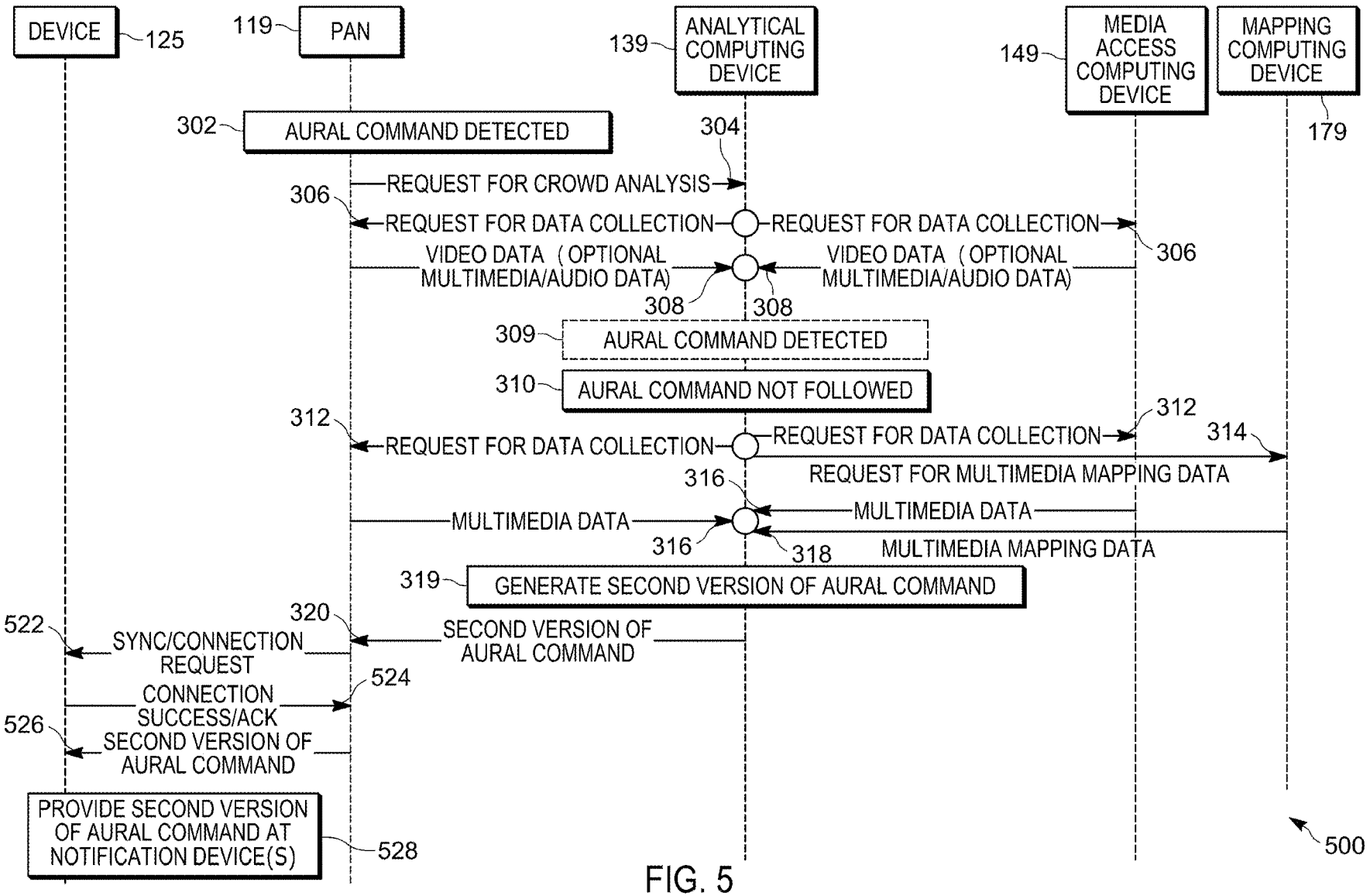
FIG. 5 is a signal diagram showing alternative communication between the components of the system of FIG. 1 when implementing the method for crowd control in accordance with some embodiments.

For example, attention is next directed to FIG. 5, which depicts a signal diagram 500 showing communication between the PAN 119, the computing device 125, the analytical computing device 139, the media access computing device 149, and (optionally) the mapping computing device 179 in an example embodiment of the method 200. The signal diagram 500 is substantially similar to the signal diagram 300 of FIG. 3, with like elements having like numbers. However, in the FIG. 5 the analytical computing device 139 may transmit 320 the second version 419 of the aural command 109 to the PAN 119, which responsively transmits 522 a SYNC/connection request, and the like, to communication devices proximal the PAN 119 which may include the computing device 125, as depicted, but which may also include other computing devices of persons in the crowd 103, such as the computing device 127.

For example, the SYNC/connection request may comprise one or more of a WiFi connection request, a Bluetooth™ connection request, a local area connection request, and the like. In some embodiments, the application 133 being executed at the computing device 125 may comprise an emergency service application 133 which may authorize the computing device 125 to automatically connect with SYNC/connection request from computing devices and/or personal area networks of emergency service and/or first responders.

In response to receiving the SYNC/connection request, the computing device 125 transmits 524 a connection success/ACK acknowledgement, and the like, to the PAN 119, which responsively transmits 526 the second version 419 of the aural command 109 to the computing device 125 (and/or any communication and/or computing devices in the crowd 103 to which the PAN 119 is in communication).

The computing device 125 provides 528 the second version 419 of the aural command 109 at one or more notification devices, such as one or more of the display device 136 and the speaker 137. Hence, the person 105 is provided with the second version 419 of the aural command 109 at their device 125, which may cause the person 105 to follow the second version 419 of the aural command 109.

Put another way, causing the second version of the aural command 109 to be provided to the one or more persons who are not following the aural command 109 at a location using the one or more notification devices comprises: identifying one or more communication devices associated with the one or more persons that are not following the aural command 109 at the location; and transmitting the second version of the aural command 109 to the one or more communication devices.

Figure 6:
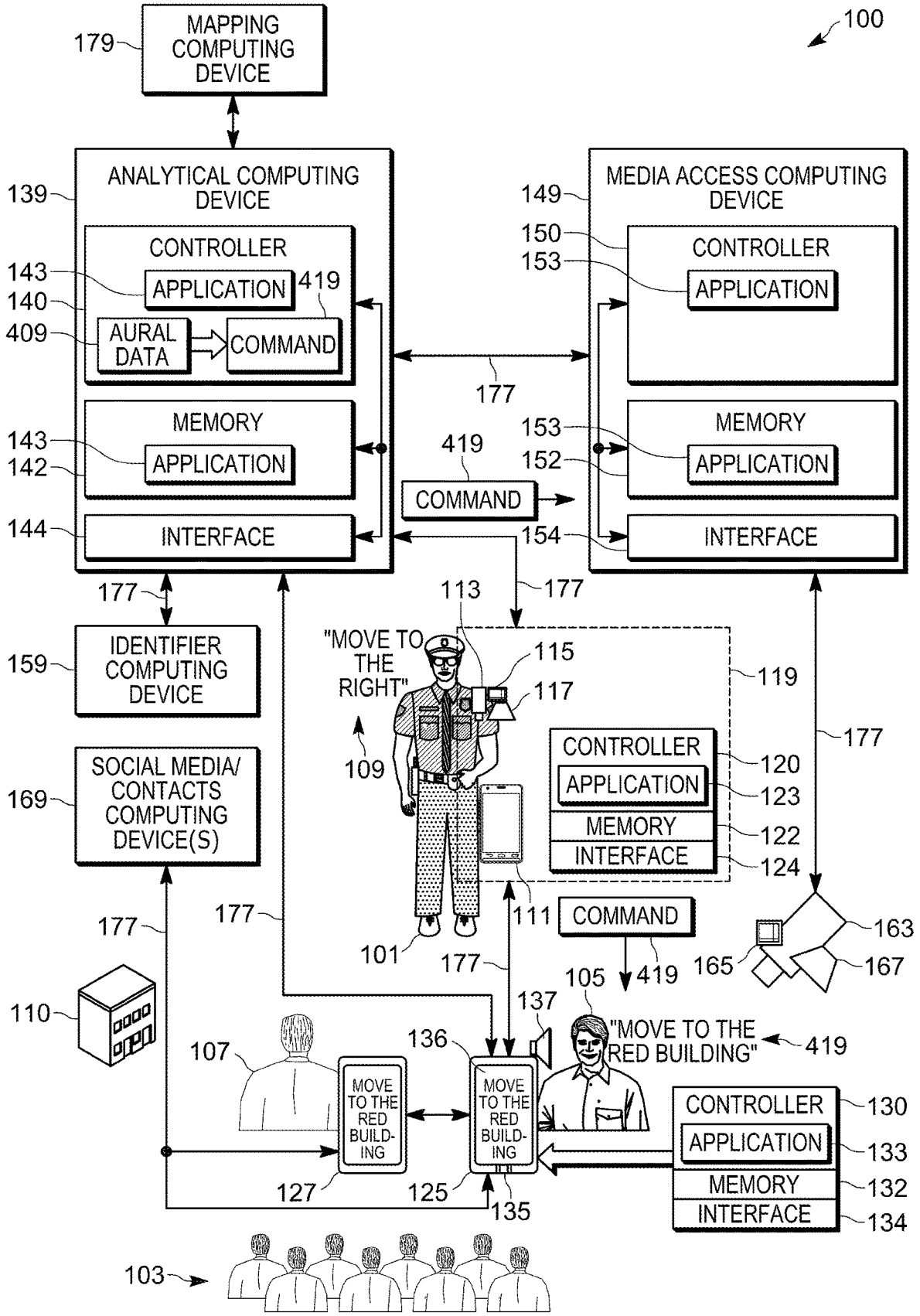
FIG. 6 depicts the second version of the aural command being provided at devices of one or more persons who are not following the aural command in accordance with some embodiments.

For example, attention is directed to FIG. 6, which is substantially similar to FIG. 5, with like elements having like numbers. In FIG. 6, the controller 130 is implementing the application 133. It is assumed in FIG. 6 that that the method 200 has been implemented as described above with respect to the signal diagram 500, and that the analytical computing device 139 has modified the aural command 109 (or rather aural data 409 representing the aural command 109) to generate the second version 419 of the aural command 109 (e.g. as depicted "MOVE TO THE RED BUILDING"). The second version 419 of the aural command 109 is transmitted to the PAN 119, which in turn transmits the second version 419 of the aural command 109 to the computing device 125. As depicted, the second version 419 of the aural command 109 is rendered and/or provided at the display device 136, and/or played as aural data emitted from the speaker 137.

As also depicted in FIG. 6, the second version 419 of the aural command 109 may also be provided at the computing device 127 and/or other communication and/or computing devices in the crowd 103. For example, the PAN 119 may also connect with the computing device 127, similar to the connection with the computing device 125 described in the signal diagram 500. Alternatively, the computing device 125 may, in turn, transmit the second version 419 of the aural command 109 to proximal communication and/or computing devices, for example using similar WiFi and/or Bluetooth™ and/or local area connections as occur with the PAN 119. Such connections may further include, but are not limited to, mesh network connections.

However, in further embodiments, the second version 419 of the aural command 109 may be transmitted to the computing device 125 (and/or other communication and/or computing devices) by the analytical computing device 139.

Figure 7:
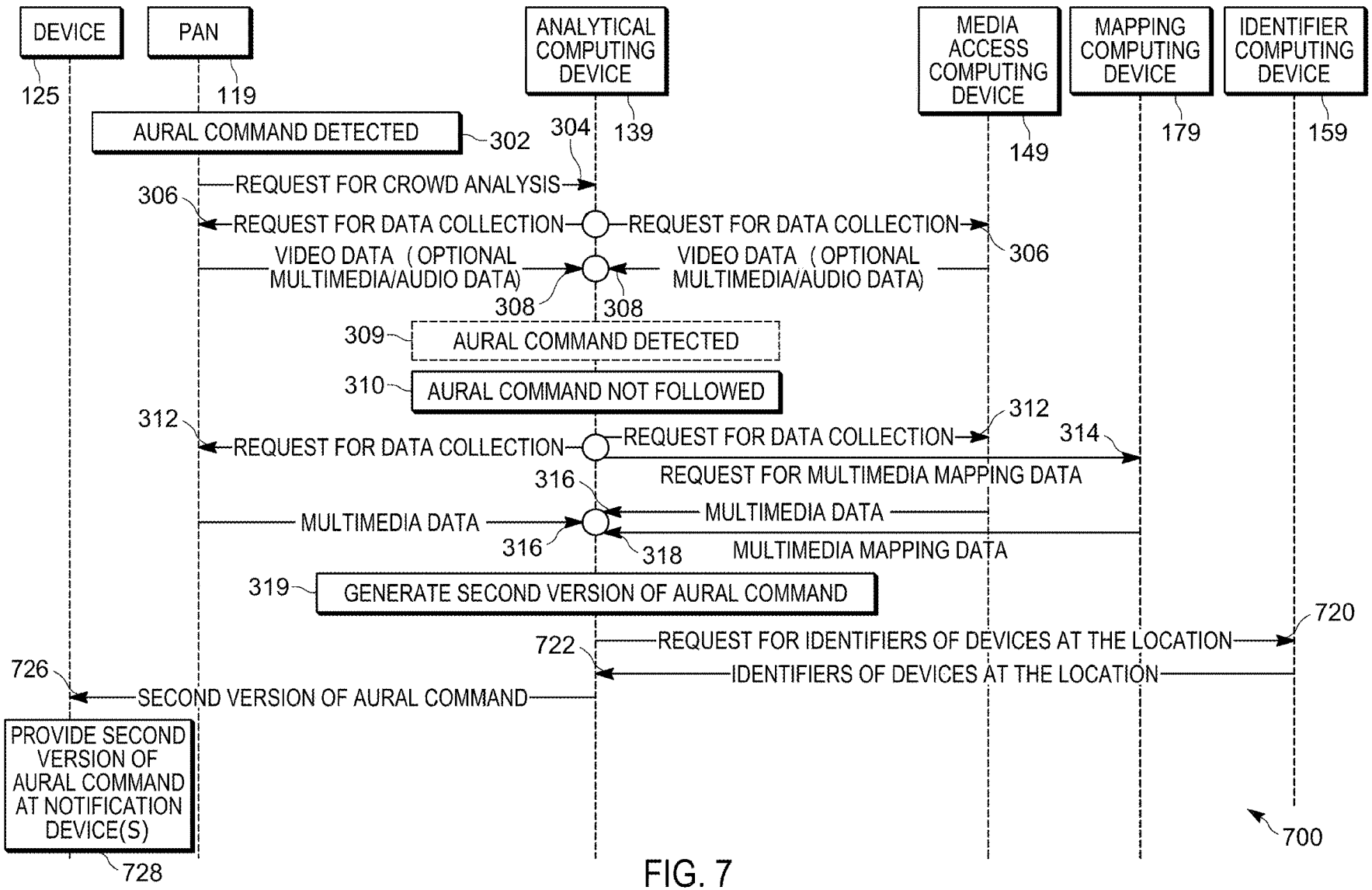
FIG. 7 is a signal diagram showing further alternative communication between the components of the system of FIG. 1 when implementing the method for crowd control in accordance with some embodiments.

For example, attention is next directed to FIG. 7, which depicts a signal diagram 700 showing communication between the PAN 119, the computing device 125, the analytical computing device 139, the media access computing device 149, the identifier computing device 159, and (optionally) the mapping computing device 179 in an example embodiment of the method 200. The signal diagram 700 is substantially similar to the signal diagram 300 of FIG. 3, with like elements having like numbers. However, in the FIG. 7 the analytical computing device 139 may request 720 identifiers of devices at the location of the incident scene from the identifier computing device 159, for example, by transmitting the location of the incident scene, as received from the PAN 119, to the identifier computing device 159.

The identifier computing device 159 responsively transmits 722 the identifiers of the devices at the location of the incident scene, the identifiers including one or more of network addresses, telephone numbers, email addresses, and the like of the devices at the location of the incident scene. It will be assumed that the identifier computing device 159 transmits 722 an identifier of the computing device 125, but the identifier computing device 159 may transmit an identifier of any identified device in the crowd 103 that the identifier computing device 159.

The analytical computing device 139 receives the device identifiers and transmits 726 the second version 419 of the aural command 109 to the computing device 125 (as well as other computing devices of persons in the crowd 103 identified by the identifier computing device 159, such as the computing device 127). For example, the second version 419 of the aural command 109 may be transmitted inn email message, a text message, a short message service (SMS)

message, a multimedia messaging service (MMS) message, and/or a phone call to the computing device 125.

Similar to the embodiment depicted in FIG. 6, the computing device 125 provides 728 the second version 419 of the aural command 109 at one or more notification devices, such as the display device 136 and/or the speaker 137.

Put another way, in the embodiment depicted in FIG. 7, causing a second version of the aural command 109 to be provided to the one or more persons who are not following the aural command at a location using the one or more notification devices comprises: communicating with a system (e.g. the identifier computing device 159) that identifies one or more communication devices associated with the one or more persons who are not following the aural command 109 at the location; and transmitting the second version of the aural command 109 to the one or more communication devices.

Furthermore, in some embodiments, the second version 419 of the aural command 109 may be personalized and/or customized for the computing device 125; for example, when device identifier may be received from the identifier computing device 159 with a name of the person 105, and the second version 419 of the aural command 109 may be personalized and/or customized to include their name. Indeed, the second version 419 of the aural command 109 may be personalized and/or customized for each computing device to which it is transmitted.

Alternatively, the second version 419 of the aural command 109 may be personalized and/or customized for each computing device to which it is transmitted to include an absolute direction and/or geographic landmark for each second version of the aural command 109. For example, while the second version 419 of the aural command 109 transmitted to the computing device 125 may instruct person 105 to move west or towards the building 110, the second version 419 of the aural command 109 transmitted to another computing device may instruct an associated person 105 to move northwest or towards another building.

In some embodiments, where the location and/or orientation of the computing devices 125, 127 (and/or other communication and/or computing devices) are periodically reported to the identifier computing device 159, the identifier computing device 159 may provide the location and/or orientation of the computing devices 125, 127 to the analytical computing device 139 along with their identifiers. The analytical computing device 139 may compare the location and/or orientation of the computing devices 125, 127 (and/or other communication and/or computing devices) with the video data and/or multimedia received from the PAN 119 and/or the media access computing device 149 to identify locations of computing devices associated with persons in the crowd 103 that are not following the aural command 109 and hence to identify device identifiers of computing devices associated with persons in the crowd 103

In these embodiments, the analytical computing device 139 may filter the device identifiers received from the identifier computing device 159 such that the second version 419 of the aural command 109 is transmitted to computing devices associated with persons in the crowd 103 that are not following the aural command 109. In other words.

However, in the computing device 125 may communicate with the analytical computing device 139, independent of the PAN 119 to implement an alternative embodiment of the method 200 in the system 100.

Figure 8:
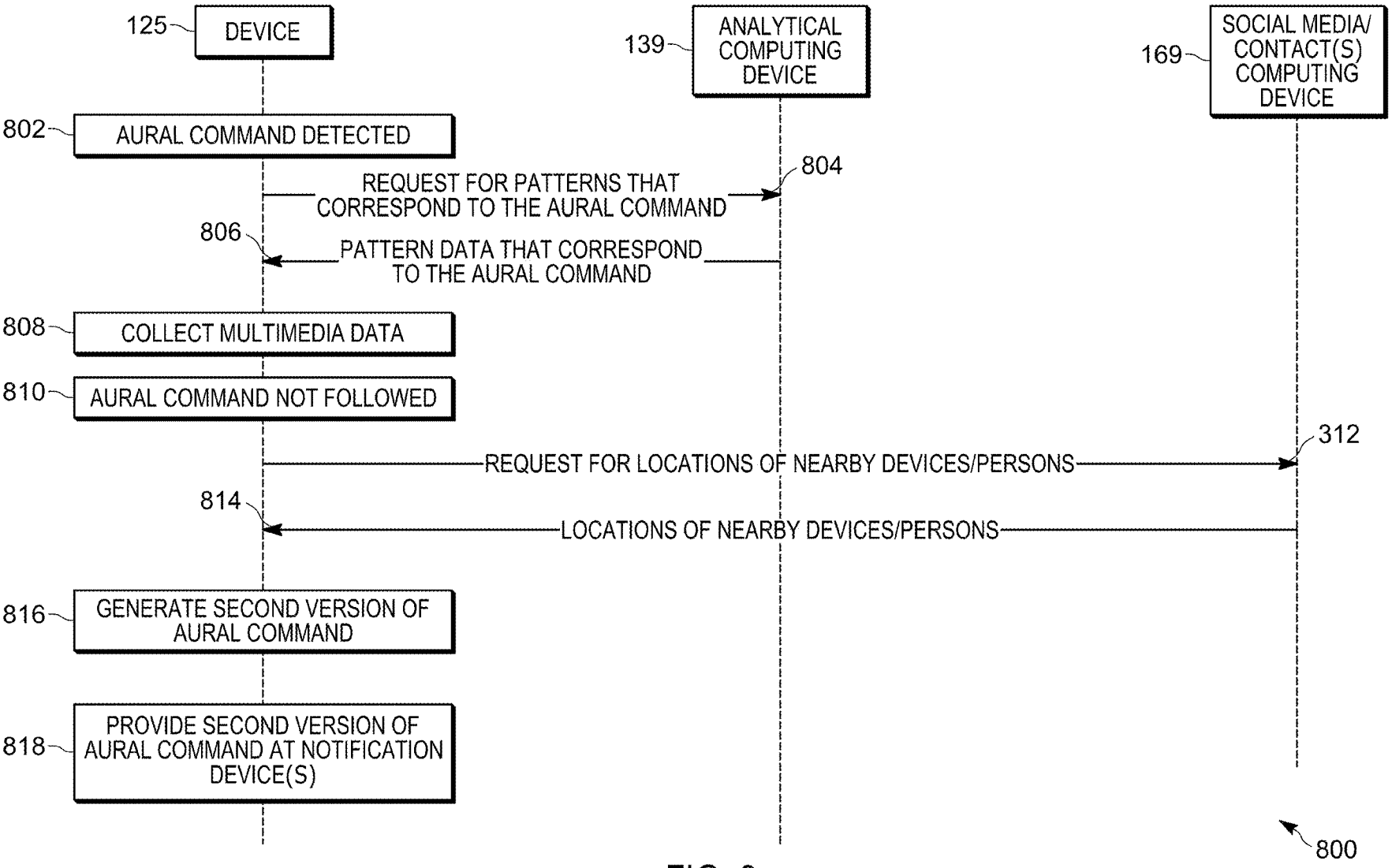
FIG. 8 is a signal diagram showing yet further alternative communication between the components of the system of FIG. 1 when implementing the method for crowd control in accordance with some embodiments.

For example, attention is next directed to FIG. 8 which depicts a signal diagram 800 showing communication between the computing device 125, the analytical computing device 139, and the social media and/or contacts computing device 169 in an alternative example embodiment of the method 200. It is assumed in FIG. 8 that the controller 130 is executing an alternative version of the application 133, and the controller 140 is executing an alternative version of the application 143. In these embodiments, the PAN 119 and the media access computing device 149 are passive, at least with respect to implementing the alternative version of the method 200.

As depicted, the computing device 125 detects 802 (e.g. at the block 202 of the method 200) the aural command 109, for example by way of the controller 130 receiving aural data from the microphone 135 and comparing the aural data with data representative of commands, similar to as described above with respect to FIG. 3; however, in these embodiments the detection of the aural command 109 occurs at the computing device 125 rather than the PAN 119 and/or the analytical computing device 139.

In response to detecting the aural command 109, the computing device 125 transmits a request 804 to the analytical computing device 139, that may include aural data representative of the aural command 109, the request 804 being for patterns that correspond to the aural command 109, and in particular movement patterns of the computing device 125 that correspond to the aural command 109. While not depicted, the analytical computing device 139 may request video data and/or multimedia data and/or mapping multimedia data from one or more of the PAN 119, the media access computing device 149 and the mapping computing device 179 to determine such patterns.

For example, when the aural command 109 comprises "MOVE TO THE RIGHT" and "RIGHT" corresponds to the computing device 125 moving west, as described above, the analytical computing device 139 generates pattern data that corresponds to the computing device 125 moving west. Such pattern data may include, for example a set of geographic coordinates, and the like, that are adjacent the location of the computing device 125 and west of the computing device 125, and/or a set of coordinates that correspond to a possible path of the computing device 125 if the computing device 125 were to move west. Such embodiments assume that the request 804 includes the location and/or orientation of the computing device 125. Such pattern data may be based on video data and/or multimedia data and/or mapping multimedia data from one or more of the PAN 119, the media access computing device 149 and the mapping computing device 179

Alternatively, the pattern data may include data corresponding to magnetometer data, gyroscope data, and/or accelerometer data and the like that would be generated at the computing device 125 if the computing device 125 were to move west.

Alternatively, the pattern data may include image data corresponding to video data that would be generated at the computing device 125 if the computing device 125 were to move west.

The analytical computing device 139 transmits 806 the pattern data to the computing device 125, and the computing device 125 collects and/or receives multimedia data from one or more sensors (e.g. a magnetometer, a gyroscope, an accelerometer, and the like), and/or a camera at the computing device 125.

The computing device 125 (e.g. the controller 130) compares the pattern data received from the analytical computing device 139 with the multimedia data to determine whether the pattern is followed or not. For example, the pattern data may indicate that the computing device 125 is to move west, but the multimedia data may indicate that the computing device 125 is not moving west and/or is standing still. Hence, the computing device 125 may determine 810 (e.g. at an alternative embodiment of the block 204 of the method 200) based one more of multimedia data and video data received from one or more multimedia devices whether one or more persons at the location are not following the aural command 109. Put another way, determining whether the one or more persons at a location are not following the aural command 109 may occur by comparing multimedia data to pattern data indicative of patterns that correspond to the aural command 109.

In yet further alternative embodiments, the computing device 125 may rely on aural data received at the speaker 135 to determine whether the person 105 is following the aural command 109. For example, when the aural command 109 is detected, audio data may be received at the speaker 137 that indicates the person 105 has not understood the aural command 109; such audio data may include phrases such as "What did he say?", "Which direction", "Where?", and the like, at are detected in response to detecting the aural command 109.

Assuming that the computing device 125 determines 810 that the aural command 109 is not followed, the computing device 125 transmits a request 812 to the social media and/or contacts computing device 169 for locations and/or presence data and/or presentity data of nearby communication and/or computing devices (e.g. within a given distance from the computing device 125), the locations and/or presence data and/or presentity data of nearby communication and/or computing devices understood to be multimedia data associated with the location of the incident scene. The request 812 may include a location of the computing device 125. Alternatively, the computing device 125 may transmit a similar request 812 to the identifier computing device 159.

As depicted, the social media and/or contacts computing device 169 returns 814 locations and/or presence data and/or presentity data of nearby communication and/or computing devices, and the computing device 125 generates 816 (e.g. at the block 206 of the method 200) a second version of the aural command 109 based on one or more of video data (e.g. received at a camera of the computing device 111) and the multimedia data associated with the location as received from the social media and/or contacts computing device 169 (and/or identifier computing device 159).

In particular, the computing device 125 generates 816 (e.g. at the block 206 of the method 200) a second version of the aural command 109 by modifying the aural command 109, similar to as described above, but based on an absolute location of a nearby computing device. For example, assuming the computing device 127 is to the west of the computing device 125 and/or located at a direction corresponding to the aural command 109, the second version of the aural command 109 generated by the computing device 125 may include one or more of an identifier of the computing device 127 and/or an identifier of the person 107 associated with the computing device 127.

The computing device 125 then provides 818 (e.g. at the block 208 of the method 200), the second version of the aural command 109 at one or more notification devices, for example the display device 136 and/or the speaker 137.

Figure 9:
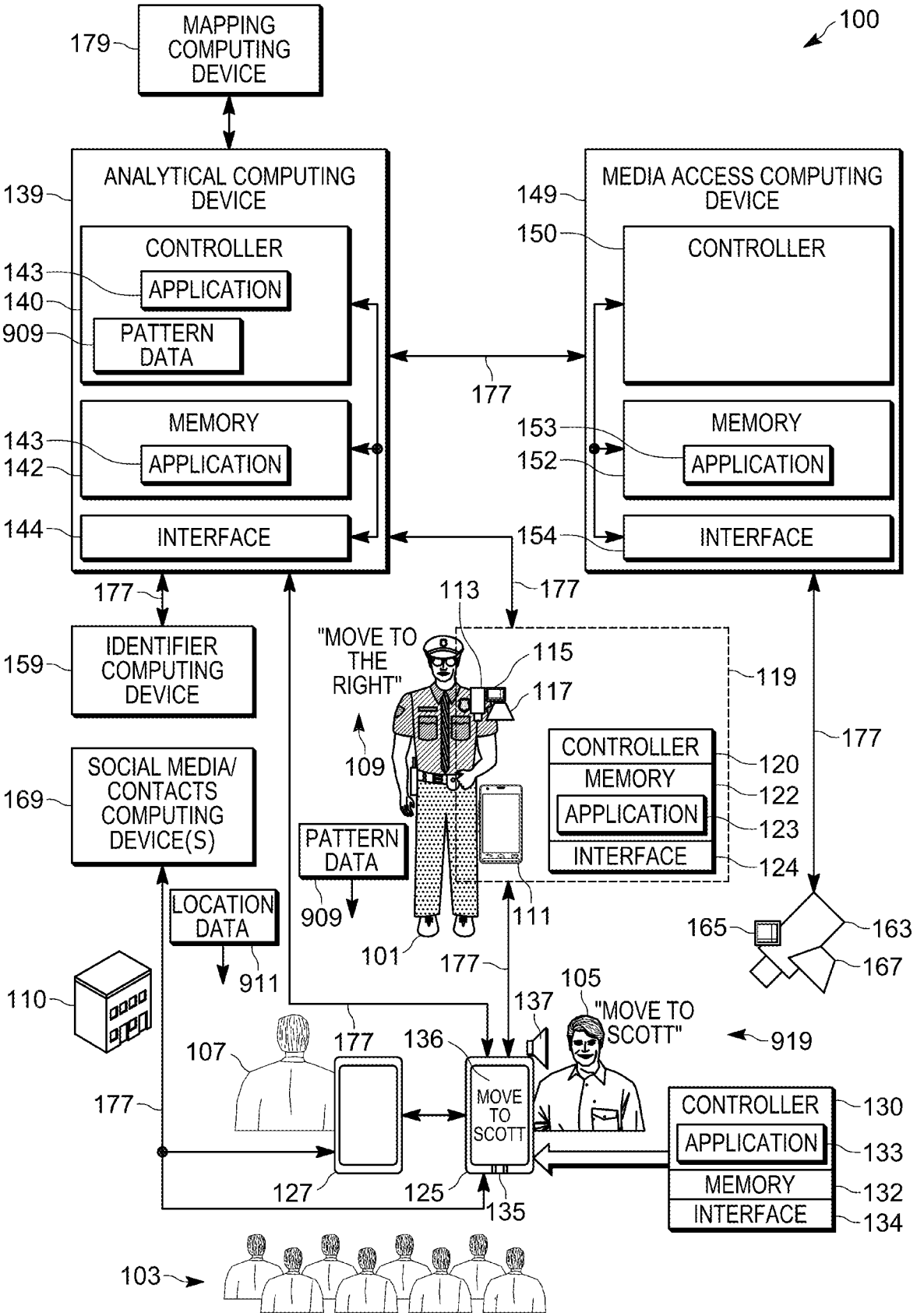
FIG. 9 depicts the second version of the aural command being provided at devices of one or more persons who are not following the aural command in accordance with some embodiments.

For example, attention is directed to FIG. 9 which is substantially similar to FIG. 1, with like elements having like numbers. However, in these embodiments, the controller 130 is implementing the application 133 and the controller 140 is implementing the application 143. As depicted, the controller 140 of the analytical computing device 149 has generated, and is transmitting to the computing device 125, pattern data 909, as described above, and the social media and/or contacts computing device 169 is transmitting location data 911, as described above.

The computing device 125 responsively determines from the pattern data 909 that the computing device 125 is not following a pattern that corresponds to the aural command 109, and further determines from the location data 911 that the computing device 127 is located in a direction corresponding to the aural command 109.

Assuming that the location data 911 further includes an identifier of the person 107 associated with the computing device 127 (e.g. "SCOTT"), the computing device 125 generates a second version 919 of the aural command 109 that includes the identifier of the person 107 associated with the computing device 127. For example, as depicted the second version 919 of the aural command 109 comprises "MOVE TO SCOTT" which is provided at the speaker 137 and/or the display device 136. Put another way, the second version 919 of the aural command 109 may include an instruction that references a given person at the location of the incident scene.

Hence, provided herein is a device, system and method for crowd control in which simplified versions of aural commands are generated and automatically provided by notification devices at a location of persons not following the aural commands. Such automatic generation of simplified versions of aural commands, and providing thereof by notification devices, may make the crowd control more efficient, which may improve crowd control, especially in emergency situations. Furthermore, such automatic generation of simplified versions of aural commands, and providing thereof by notification devices may reduce inefficient use of megaphones, and the like by responders issuing the commands.

In the foregoing specification, specific embodiments have been described. However, one of ordinary skill in the art appreciates that various modifications and changes may be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

In this document, language of "at least one of X, Y, and Z" and "one or more of X, Y and Z" may be construed as X only, Y only, Z only, or any combination of two or more items X, Y, and Z (e.g., XYZ, XY, YZ, ZZ, and the like). Similar logic may be applied for two or more items in any occurrence of "at least one . . . " and "one or more . . . " language.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment may be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it may be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A method comprising:

detecting, at one or more computing devices, that an aural command has been detected at a location using a microphone at the location, the aural command issued by a person at the location;

determining, at the one or more computing devices, based on video data received from one or more multimedia devices whether one or more persons at the location are not following the aural command;

modifying the aural command, at the one or more computing devices, to generate a second version of the aural command based on one or more of the video data and multimedia data associated with the location; and causing, at the one or more computing devices, the second version of the aural command to be provided, to the one or more persons who are not following the aural command at the location using one or more notification devices.

2. The method of claim 1, wherein the second version of the aural command comprises one or more of: a second aural command provided at a speaker notification device; and a visual command provided at a visual notification device.

3. The method of claim 1, wherein the second version of the aural command comprises a simplified version of the aural command.

4. The method of claim 1, wherein the second version of the aural command includes an instruction that references to a geographic landmark at the location.

5. The method of claim 1, wherein the second version of the aural command includes an instruction that references a given person at the location.

6. The method of claim 1, wherein the determining whether the one or more persons at the location are not following the aural command occurs using one or more of: the video data; and video analytics on the video data.

7. The method of claim 1, wherein the determining whether the one or more persons at the location are not following the aural command occurs by comparing the multimedia data to pattern data indicative of patterns that correspond to the aural command.

8. The method of claim 1, wherein the causing the second version of the aural command to be provided to the one or more persons who are not following the aural command at the location using the one or more notification devices comprises:

providing the second version of the aural command to a communication device of the person that issued the aural command.

9. The method of claim 1, wherein the causing the second version of the aural command to be provided to the one or more persons who are not following the aural command at the location using the one or more notification devices comprises: identifying one or more communication devices associated with the one or more persons that are not following the aural command at the location; and transmitting the second version of the aural command to the one or more communication devices.

10. The method of claim 1, wherein the causing the second version of the aural command to be provided to the one or more persons who are not following the aural command at the location using the one or more notification devices comprises: communicating with a system that identifies one or more communication devices associated with the one or more persons who are not following the aural command at the location; and transmitting the second version of the aural command to the one or more communication devices.

11. A computing device comprising:

a controller and a communication interface, the controller configured to:

detect that an aural command has been detected at a location using a microphone at the location, the aural command issued by a person at the location, the communication interface configured to communicate with the microphone;

determine, based on video data received from one or more multimedia devices, whether one or more persons at the location are not following the aural command, the communication interface further configured to communicate with the one or more multimedia devices;

modify the aural command to generate a second version of the aural command based on one or more of the video data and multimedia data associated with the location; and cause the second version of the aural command to be provided, to the one or more persons who are not following the aural command at the location using one or more notification devices, the communication interface further configured to communicate with the one or more multimedia devices.

12. The computing device of claim 11, wherein the second version of the aural command comprises one or more of: a second aural command provided at a speaker notification device; and a visual command provided at a visual notification device.

13. The computing device of claim 11, wherein the second version of the aural command comprises a simplified version of the aural command.

14. The computing device of claim 11, wherein the second version of the aural command includes an instruction that references to a geographic landmark at the location.

15. The computing device of claim 11, wherein the second version of the aural command includes an instruction that references a given person at the location.

16. The computing device of claim 11, wherein the controller is further configured to determine whether the one or more persons at the location are not following the aural command using one or more of: the video data; and video analytics on the video data.

17. The computing device of claim 11, wherein the controller is further configured to whether the one or more persons at the location are not following the aural command by comparing the multimedia data to pattern data indicative of patterns that correspond to the aural command.

18. The computing device of claim 11, wherein the controller is further configured to cause the second version of the aural command to be provided to the one or more persons who are not following the aural command at the location using the one or more notification devices by: providing the second version of the aural command to a communication device of the person that issued the aural command.

19. The computing device of claim 11, wherein the controller is further configured to cause the second version of the aural command to be provided to the one or more persons who are not following the aural command at the location using the one or more notification devices by: identifying one or more communication devices associated with the one or more persons that are not following the aural command at the location; and transmitting the second version of the aural command to the one or more communication devices.

20. The computing device of claim 11, wherein the controller is further configured to cause the second version of the aural command to be provided to the one or more persons who are not following the aural command at the location using the one or more notification devices by: communicating with a system that identifies one or more communication devices associated with the one or more persons who are not following the aural command at the location; and transmitting the second version of the aural command to the one or more communication devices.

* * * * *